US005802920A

United States Patent [19]

Becker

[11] Patent Number: 5,802,920

[45] Date of Patent: Sep. 8, 1998

[54] DOUBLE GEAR WHEEL OF A TURNING DEVICE ON PRINTING PRESSES

[75] Inventor: Willi Becker, Bammental, Germany

[73] Assignee: Heidelberger Druckmaschinen Aktiengesellschaft, Heidelberg, Germany

[21] Appl. No.: 746,757

[22] Filed: Nov. 14, 1996

[30] Foreign Application Priority Data

| | | | |
|---|---|---|---|
| Nov. 15, 1995 | [DE] | Germany | 295 18 072.2 |
| Sep. 16, 1996 | [DE] | Germany | 196 37 612.2 |

[51] Int. Cl.[6] ..... B41F 13/12

[52] U.S. Cl. ..... 74/439; 74/440; 74/395; 101/248; 101/230

[58] Field of Search ..... 101/248, 230; 403/374, 370, 368; 192/66.2; 74/439, 440, 444, 448, 395

[56] References Cited

U.S. PATENT DOCUMENTS

| | | | |
|---|---|---|---|
| 2,625,101 | 1/1953 | Gammeter | 101/230 |
| 3,296,881 | 1/1967 | Seabeck | 74/440 |
| 3,724,368 | 4/1973 | Treff | 101/248 |
| 3,772,990 | 11/1973 | Weisgerber | 101/230 |
| 3,796,154 | 3/1974 | Weisgerber | 101/230 |
| 3,829,084 | 8/1974 | Jurny | 101/230 |
| 4,014,261 | 3/1977 | Becker | 101/230 |
| 4,122,773 | 10/1978 | Wirz | 101/230 |
| 4,147,105 | 4/1979 | Becker | 101/230 |
| 4,362,099 | 12/1982 | Iwamoto | 101/230 |
| 4,444,106 | 4/1984 | Frenzel et al. | 101/230 |
| 4,457,231 | 7/1984 | Kawaguchi | 101/230 |
| 4,580,494 | 4/1986 | Becker | 101/230 |
| 4,716,827 | 1/1988 | Wieland et al. | 101/230 |
| 4,735,140 | 4/1988 | Wieland et al. | 101/230 |
| 4,782,717 | 11/1988 | Becker | 101/248 |
| 4,787,261 | 11/1988 | Becker | 101/248 |
| 4,831,929 | 5/1989 | Saito | 101/230 |
| 5,031,531 | 7/1991 | Becker | 101/230 |
| 5,048,362 | 9/1991 | Becker et al. | 101/248 |
| 5,063,843 | 11/1991 | Becker | 101/230 |
| 5,076,164 | 12/1991 | Becker | 101/230 |
| 5,136,946 | 8/1992 | Becker | 101/230 |
| 5,213,035 | 5/1993 | Becker | 101/230 |
| 5,265,528 | 11/1993 | Mathes | 101/230 |
| 5,365,845 | 11/1994 | Becker | 101/230 |
| 5,410,959 | 5/1995 | Sugiyama et al. | 101/230 |
| 5,584,241 | 12/1996 | Yuasa | 101/230 |
| 5,588,363 | 12/1996 | Becker | 101/230 |

FOREIGN PATENT DOCUMENTS

| | | | |
|---|---|---|---|
| 0635364 | 1/1995 | European Pat. Off. . | |
| 2110962 | 9/1971 | Germany | 101/230 |
| 2419747 | 11/1975 | Germany . | |
| 2535113 | 2/1977 | Germany | 101/230 |
| 3820026 | 12/1989 | Germany . | |
| 58-71163 | 4/1983 | Japan | 101/230 |
| 390314 | 11/1973 | Russian Federation | 74/440 |
| 1214436 | 12/1970 | United Kingdom | 101/230 |

*Primary Examiner*—Edgar S. Burr
*Assistant Examiner*—Amanda B. Sandusky
*Attorney, Agent, or Firm*—Nils H. Ljungman and Associates

[57] ABSTRACT

A double gear wheel of a turning device on printing presses comprises an adjustment gear wheel (4). On the adjustment gear wheel a conical seat (7) is formed, which conical seat (7) is engaged in a conical recess (9) formed on the corresponding stationary gear wheel (2), when the two gear wheels (2, 4) are clamped to one another by means of a clamping body (5). The double gear wheel described above has a compact construction, is easy to manufacture with a high degree of precision, and without the requirement for any additional elements essentially guarantees a frictional engagement which reliably prevents the mutual rotation of the two gear wheels (2, 4) during operation of the printing press, even on printing presses which consist of a large number of printing mechanisms.

20 Claims, 3 Drawing Sheets

DOUBLE GEAR WHEEL OF A TURNING DEVICE ON PRINTING PRESSES

BACKGROUND OF THE INVENTION

1. Field of the Invention

This invention relates generally to a double gear wheel of a turning device on printing presses, in which an adjustment or adjustable gear wheel can be non-positively or frictionally connected in its rotational position to a stationary or fixed gear wheel by means of a conical seat formed on the adjustment gear wheel and a clamping means containing a clamping body.

2. Background Information

German Patent No. 38 20 026 C2 (which corresponds to U.S. Pat. No. 5,048,362) discloses a double gear wheel on which an adjustment gear wheel can be modified in its rotational position with respect to a fixed gear wheel. This adjustment capability is necessary, for example, so that when the paper is to be printed on both sides, the grippers can be adjusted so that they correspond to the respective sheet format to be processed. In this case it is essential that the two gear wheels are clamped during operation of the machine so that they cannot rotate with respect to one another. Consideration also must be given to the fact that on presses which have a plurality of printing mechanisms, the clamping must transmit a high drive power. For this purpose, the known device uses an expensive friction disc clutch or coupling to obtain a good frictional engagement for the transmission of the high torque required.

In another known double gear wheel, as disclosed in German Patent No. 24 19 747 C2 (which corresponds to U.S. Pat. No. 4,122,773), individual clamping bodies are used which do not reliably eliminate the risk of a mutual rotation between the two gear wheels.

European Patent No. 0 635 364 discloses a double gear wheel on which the clamping of the fixed gear wheel with the corresponding adjustable gear wheel is achieved by means of a conical seat which is formed on the adjustable gear wheel and an engagement element which has a conical peripheral surface. The engagement element can be displaced in the axial direction and is mounted in bodies of the stationary gear wheel. As a result of the use of an additional engagement element which has a conical peripheral surface, on the known apparatus, on account of the unavoidable concentricity tolerances in the manufacture of the components, there are very strict requirements regarding the precision of the parts used. On the known apparatus described above, the clamping force with which the adjustment gear wheel is clamped is effective primarily in the radial direction away from the center, so that during the clamping process, there is a risk that the adjustment gear wheel will be expanded, and the gearing or the diameter of the gearing can change disadvantageously.

OBJECT OF THE INVENTION

On the basis of the known double gear wheels described above, the object of the present invention is to create a double gear wheel for the turning device of a printing press, which double gear wheel can be Manufactured easily and with a high degree of precision, and which employs a simple and compact construction without additional means to create a frictional engagement which reliably prevents the mutual rotation of the two gear wheels during the operation of the printing press, even on printing presses which have a large number of printing mechanisms.

SUMMARY OF THE INVENTION

The invention teaches that this object can be accomplished by the feature that the conical seat is formed by a conical internal boring formed in the adjustment gear wheel and a conical projection which is formed on the stationary gear wheel and extends into the internal boring, and that the clamping body is engaged on the side of the adjustment gear wheel opposite the stationary gear wheel, to clamp the gear wheels in the axial direction.

The invention teaches that on the adjustment gear wheel, a conical seat is formed which is engaged in a recess which is formed directly on the stationary gear wheel. As a result, not only is there a compact and simple construction, but an additional advantage is that with a corresponding arrangement of the conical seats, the clamping of the adjustment gear wheel takes place radially inward, i.e. toward the center of the adjustment gear wheel. As a result of the use of a conical seat, significantly higher torques can be transmitted with the same clamping means, without worrying about a mutual adjustment of the two gear wheels in relation to one another, even if the drive power must be transmitted to a plurality of printing mechanisms.

In other words, when the conical seat and the recess are clamped together, a large frictional force results between the two gear wheels, which large frictional force prevents relative motion between the two gear wheels upon clamping. Thus, large torques can be transmitted between the gear wheels. The large frictional force results from the large contact force or normal force between the conical seat and the recess, which contact force is related to the angle of taper of the conical seat. The frictional force is related to the normal force and the coefficient of friction between the conical seat and the recess. The coefficient of friction is related to the material from which the gear wheels are constructed and the way in which the surfaces of the conical seat and the recess are finished.

As a result of the configuration of the conical seat at such an angle that it is not self-locking nor irreversible, the invention essentially guarantees that a simple adjustment is possible when the clamping means are released.

That is, the angle of taper of the conical seat is preferably chosen so that a large clamping force is exerted on the adjustment gear wheel, but at the same time the conical seat and the recess do not lock together; they are non-locking. That is, the conical seat can be disengaged from the recess easily or with a relatively small amount of effort on the part of the press operator. If the surfaces were to lock together, additional time and effort would be required to make an adjustment of the adjustment gear wheel, because before an adjustment could be made, the adjustment gear wheel would have to be unlocked or forcefully separated from the fixed gear wheel. In fact, if the angle of taper of the cone were very small, it may become nearly impossible to separate the two gear wheels from one another, even with a very large force.

In an additional embodiment, the conical seat is formed on a ring-shaped projection of the adjustment gear wheel.

In an additional embodiment, there is an additional ring-shaped projection with an additional conical seat on the side of the adjustment gear: wheel opposite the conical seat, which additional ring-shaped projection is engaged in an additional conical recess formed on the clamping body.

An additional variant of the invention is characterized by the fact that the clamping body is secured by means of studs with respect to the stationary gear wheel.

The invention also teaches that the conical seat can also be formed by a conical internal boring in the adjustment gear wheel, and by a conical projection formed on the stationary gear wheel, which conical projection extends into the internal boring, and the clamping body is engaged on the side of the adjustment gear wheel opposite the stationary gear wheel to clamp the gear wheels in the axial direction.

An additional advantageous embodiment of the invention is characterized by the fact that the conical seat is formed on a ring-shaped projection of the adjustment gear wheel, which ring-shaped projection is engaged in an additional conical recess formed on the clamping body. As a result of this simple configuration, a high coefficient of friction is achieved, and simultaneously the freedom of movement in the mounting of the adjustment gear wheel during the operation of the machine is guaranteed.

An alternative configuration is characterized by the fact that the conical seat is provided on a ring-shaped projection of the adjustment gear wheel, which ring-shaped projection is engaged in a conical recess in the clamping body, and that the clamping body is rotationally secured with respect to the fixed gear wheel by means of studs. In this configuration, the adjustment gear wheel can be mounted in the snug fit and the frictional engagement is accomplished only by means of the clamping body, so that here again, a freedom of movement is guaranteed.

In an additional embodiment, on both sides of the adjustment gear wheel there are conical ring-shaped projections which are engaged in conical recesses on the fixed gear wheel and the clamping body. This solution can be advantageous, for example, for the transmission of very high torques.

An additional variant of the invention is characterized by the fact that the inner boring of the adjustment gear wheel is realized so that it is conical, and the adjustment gear wheel is mounted on a conical projection which is provided on the fixed gear wheel. When the adjustment gear wheel has a large gear wheel cross section, this solution can be realized easily, without any reason to fear an expansion of the adjustment guide wheel during clamping.

One feature of the invention resides broadly in a double gear wheel of a turning device for a printing press, the double gear wheel comprising: an adjustable gear wheel; a fixed gear wheel; the fixed gear wheel comprising an arrangement for being fixedly connected to a shaft of a printing press; an arrangement for frictionally connecting the adjustable gear wheel to the fixed gear wheel to permit adjustment of the adjustable gear wheel in a rotational direction with respect to the fixed gear wheel; the frictional connecting arrangement comprising a conical seat disposed on the adjustable gear wheel; the frictional connecting arrangement comprising a conical recess disposed on the fixed gear wheel; and the conical seat being engaged in the conical recess.

Another feature of the invention resides broadly in a double gear wheel of a turning device for a printing press, the double gear wheel comprising: an adjustable gear wheel; a fixed gear wheel; the fixed gear wheel comprising an arrangement for being fixedly connected to a shaft of a printing press; an arrangement for frictionally connecting the adjustable gear wheel to the fixed gear wheel to permit adjustment of the adjustable gear wheel in a rotational direction with respect to the fixed gear wheel; the adjustable gear wheel comprises an internal bore; the internal bore comprises an internal bore surface; the frictional connecting arrangement comprising a conical seat disposed on the internal bore surface; the frictional connecting arrangement comprising a conical projection projecting from the fixed gear wheel into the internal bore; and the conical seat being engaged by the conical projection.

Yet another feature of the invention resides broadly in a double gear wheel in a turning device for a printing press, the double gear wheel comprising: an adjustable gear wheel; a fixed gear wheel; the fixed gear wheel being fixedly connected to a shaft of a printing press; an arrangement for frictionally connecting the adjustable gear wheel to the fixed gear wheel to permit adjustment of the adjustable gear wheel in a rotational direction with respect to the fixed gear wheel; the frictional connecting arrangement comprising a conical seat disposed on the adjustable gear wheel; the frictional connecting arrangement comprising a conical recess disposed on the fixed gear wheel; and the conical seat being engaged in the conical recess.

A further feature of the invention resides broadly in a double gear wheel in a turning device for a printing press, the double gear wheel comprising: an adjustable gear wheel; a fixed gear wheel; the fixed gear wheel being fixedly connected to a shaft of a printing press; an arrangement for frictionally connecting the adjustable gear wheel to the fixed gear wheel to permit adjustment of the adjustable gear wheel in a rotational direction with respect to the fixed gear wheel; the adjustable gear wheel comprises an internal bore; the internal bore comprises an internal bore surface; the frictional connecting arrangement comprising a conical seat disposed on the internal bore surface; the frictional connecting arrangement comprising a conical projection projecting from the fixed gear wheel into the internal bore; and the conical seat being engaged by the conical projection.

BRIEF DESCRIPTION OF THE DRAWINGS

One embodiment of the invention is illustrated schematically in the accompanying drawings.

DESCRIPTION OF THE PREFERRED EMBODIMENT

Figure 1:
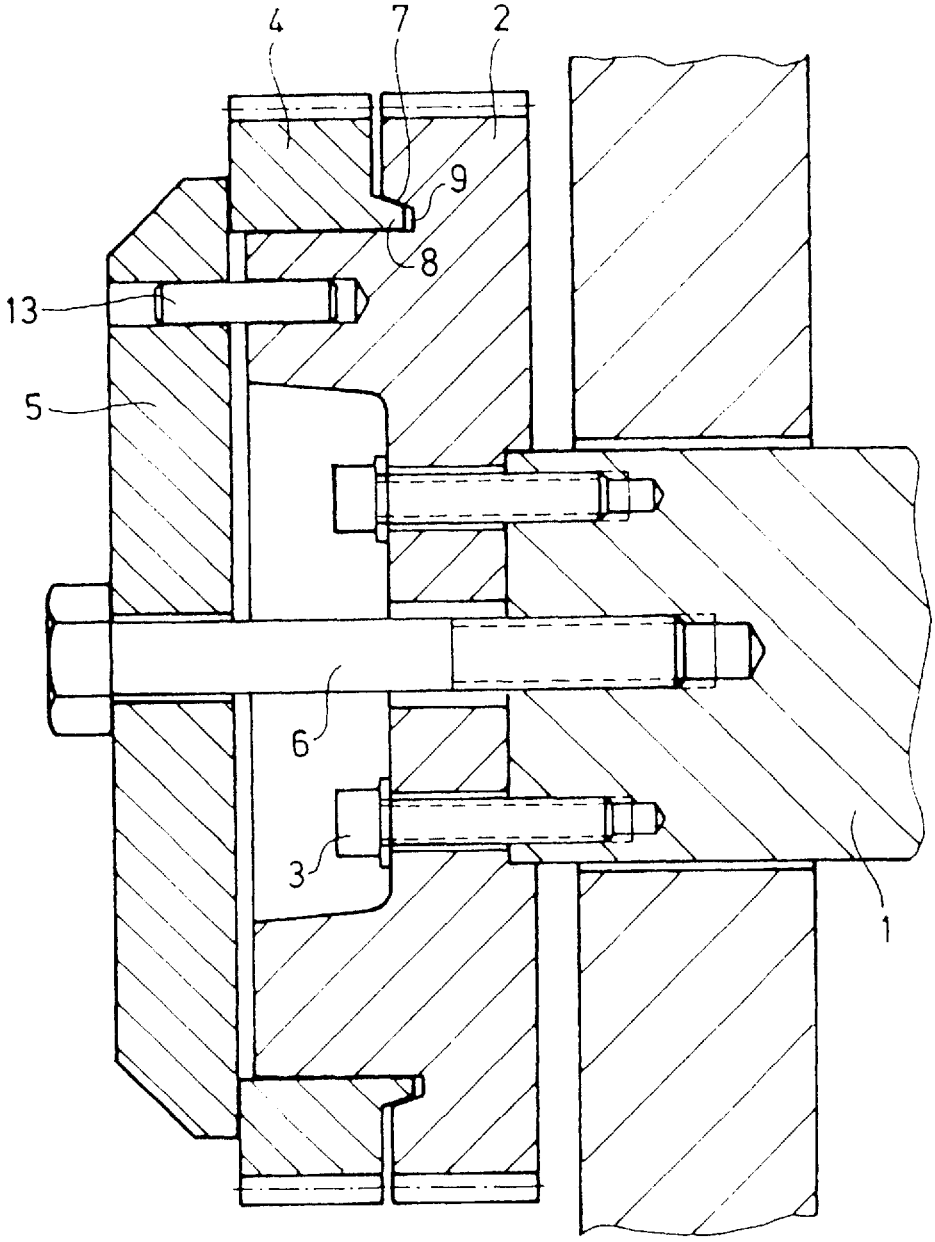
FIG. 1 is a partial longitudinal section through the double gear wheel.

As FIG. 1 shows, a stationary or fixed gear wheel 2 is fastened or fixed, for example by means of screws 3, on an axle journal or axle stub 1 of a cylinder or drum of a turning device. Corresponding to the stationary gear wheel 2 is an adjustment or adjustable gear wheel 4. The rotational position of the adjustment gear wheel 4 with respect to the stationary gear wheel 2 can be adjusted, and the adjustment gear wheel 4 can be connected to the stationary gear wheel 2 by means of a clamping body 5. For a non-positive clamping of the two gear wheels, there are clamping means 6 which, in the illustrated embodiment, consist of one or more clamping screws. The adjustment gear wheel 4 is axially clamped to the stationary gear wheel 2 by the force of these clamping means.

In the illustrated embodiment, there is a conical seat 7 on the adjustment gear wheel 4, which conical seat is realized on a ring-shaped projection 8 of the adjustment gear wheel 4. Opposite the ring-shaped projection 8, there is a conical recess 9 on the stationary gear wheel 2, in which the ring-shaped projection 8 is engaged by means of its conical seat 7, so that by pressing the adjustment gear wheel 4 in the axial direction of the conical seat, the adjustment gear wheel 4 is clamped to the stationary gear wheel 2 to create a very strong frictional engagement. This clamping occurs in the operating condition of the printing press, whereby the conical seat 7 is not self-locking, to make an easy adjustment possible.

Figure 2:
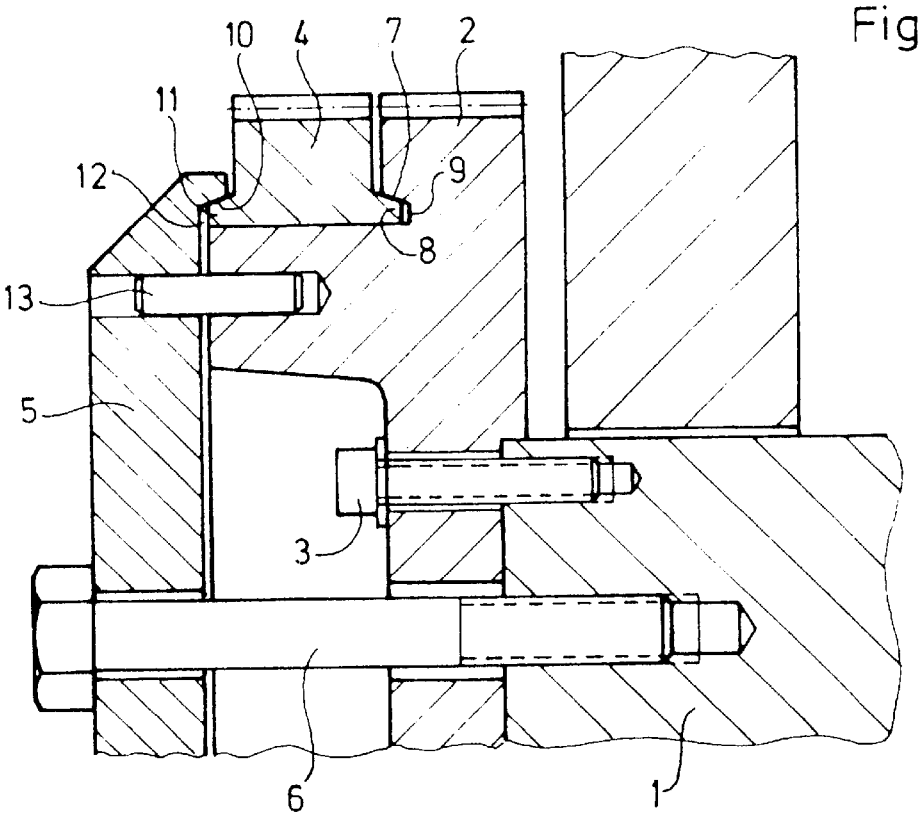
FIG. 2 is a partial longitudinal section through a variant realization of the double gear wheel.

As shown in FIG. 2, there can be a conical seat 10 on a ring-shaped projection 11 on the adjustment gear wheel 4, which conical seat 10 is engaged in a conical recess 12 on the clamping body 5. The clamping body is advantageously secured by studs 13 to prevent rotation with respect to the stationary gear wheel 2. As shown in FIG. 2, there can also be conical ring-shaped projections 8, 11 on either side of the adjustment gear wheel 4, which ring-shaped projections are engaged in conical recesses 9, 12, so that an increased frictional engagement is created during clamping.

Figure 3:
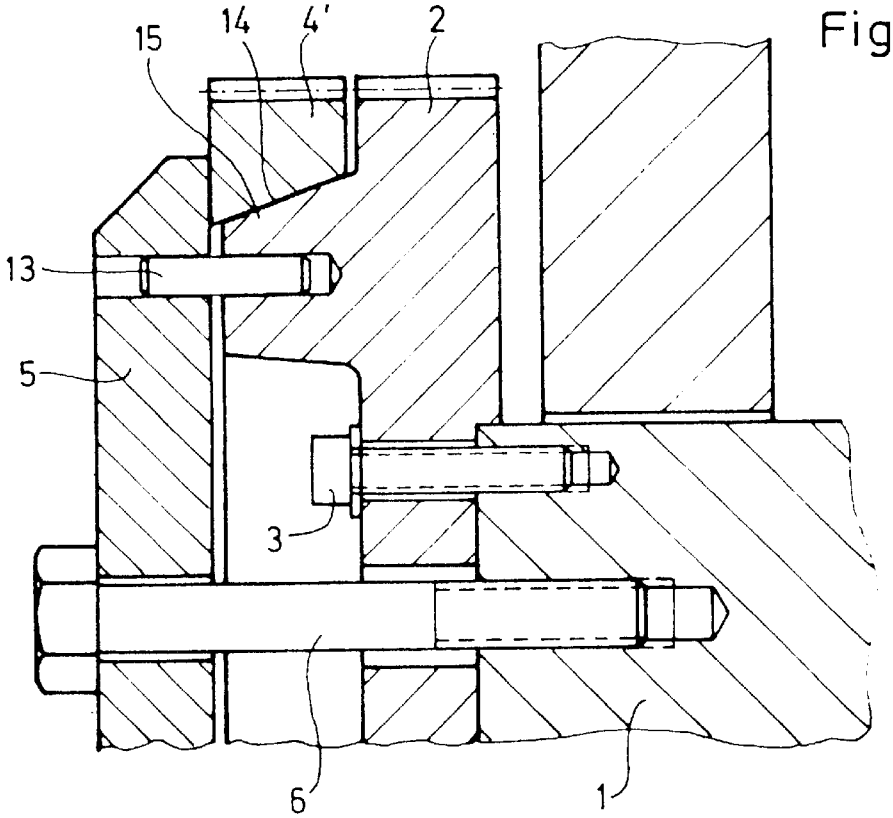
FIG. 3 is a partial longitudinal section through a double gear wheel with a conical seat.

The variant embodiment illustrated in FIG. 3 shows a mounting of an adjustment gear wheel 4' on a conical internal boring 14. On the stationary gear wheel 2 there is a likewise conical projection 15 on which the adjustment gear wheel 4' is mounted. If an axial force is exerted on the adjustment gear wheel 4', then a very tight frictional engagement is created by the conical seat. This embodiment is recommended if the adjustment gear wheel 4' has a sufficiently large cross section so that no expansion can occur. With this mounting of the adjustment gear wheel, it can also be essentially guaranteed that there is no play during the operation of the machine.

In the variant embodiment illustrated in FIG. 3, the adjustment gear wheel 4' takes the form of a ring having a conical bore 14 on the inside surface of the gear. The ring of the adjustment gear wheel 4', which ring is disposed between an outside surface of the adjustment gear wheel 4' and the conical bore, represents a cross section of the adjustment gear wheel 4'. If the cross section of the ring of the adjustment gear wheel is too small, the adjustment gear wheel will tend to expand under the force produced by clamping. Therefore, it is important that an adjustment gear wheel 4', of the embodiment of FIG. 3, has a large enough cross section to avoid substantial or harmful expansive deformation of the adjustment gear wheel upon clamping.

In the embodiments described above, it is advantageous if the conical seats 7, 10, as shown in the drawings, are designed or inclined so that the adjustment gear wheel 4 is clamped toward its center, when the adjustment gear wheel 4 is pressed by the clamping body 5 on the stationary gear wheel 2. In this case, the adjustment gear wheel 4 is pressed onto its guide seat on the stationary gear wheel 2, as a result of which changes in the diameter of the gearing of the adjustment gear wheel 4 can be reliably prevented when high clamping forces are applied.

In other words, the conical seats 7, 10 are designed to taper towards the center of rotation of the adjustment gear wheel 4, as the conical seats 7, 10 extend outward from the side of the adjustment gear wheel 4 (as shown in FIG. 2). Thus, when the clamping body 5 is applied, the force exerted on the conical seats 7, 10 is generally directed towards the center of rotation of the adjustment gear wheel 4, thereby preventing expansion of the adjustment gear wheel. If the conical seats 7, 10 were oriented to taper in the opposite direction, then expansion of the adjustment gear wheel 4 can change the diameter of the adjustment gear wheel 4. Such a change in the diameter of the adjustment gear wheel can be undesirable.

The angle of the conical seats 7, 10 and the conical recesses 9, 12 may depend on the demands of the specific printing press. The material from which the gear wheels 2, 4 are made can also affect the angle of the conical seats 7, 10 and the conical recesses 9, 12, as can the finish of the contact surfaces of the conical seats 7, 10 and the conical recesses 9, 12. Other factors which could influence the conical angle include the coefficient of friction of the material, the thickness and elasticity of the material, and other factors well known to affect the functioning of conical clutches. The angle of taper of the conical seats 7, 10 is preferably chosen so that a large clamping force is exerted on the adjustment gear wheel 4, but at the same time the conical seats 7, 10 and the recesses 9, 12 do not lock together. That is, the conical seats 7, 10 can be disengaged from the conical recesses 9, 12 easily or with a relatively small amount of effort on the part of the press operator. The conical seats 7, 10 are said to not be self locking with respect to the conical recesses 9, 12. If the surfaces of the conical seats 7, 10 and the conical recesses 9, 12 were to lock together, additional time and effort would be required to make an adjustment of the adjustment gear wheel 4, because before an adjustment could be made, the adjustment gear wheel 4 would have to be unlocked or forcefully separated from the fixed gear wheel 2. In fact, if the angle of taper of the conical seats 7, 10 were very small, it may become nearly impossible to separate the two gear wheels 2, 4 from one another, even with a very large force.

A discussion of cone clutches can be found in the book by J. E. Sigley; *Mechanical Engineering Design;* Second Edition; McGraw-Hill Book Company; 1963; pages 601–603. The cone angle and the diameter and face width of the cone are the important parameters. If the cone angle is too small, less than about 8 degrees, then the disengagement force required is quite large. On the other hand, the wedging effect lessens rapidly when large cone angles are used. Depending on the characteristics of the friction materials, a good compromise can usually be found between 10 and 15 degrees.

The typical angle of the conical surfaces is about 20 degrees from the horizontal. However, a range of angles, 5 degrees to 40 degrees, from the horizontal including the following may possibly be used: 5 degrees, 6 degrees, 7 degrees, 8 degrees, 9 degrees, 10 degrees, 11 degrees, 12 degrees, 13 degrees, 14 degrees, 15 degrees, 16 degrees, 17 degrees, 18 degrees, 19 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, 37 degrees, 38 degrees, 39 degrees, and 40 degrees. In some situations angles outside this range may be used. Similar angles can also be used in the embodiment of FIG. 3.

Figure 4:
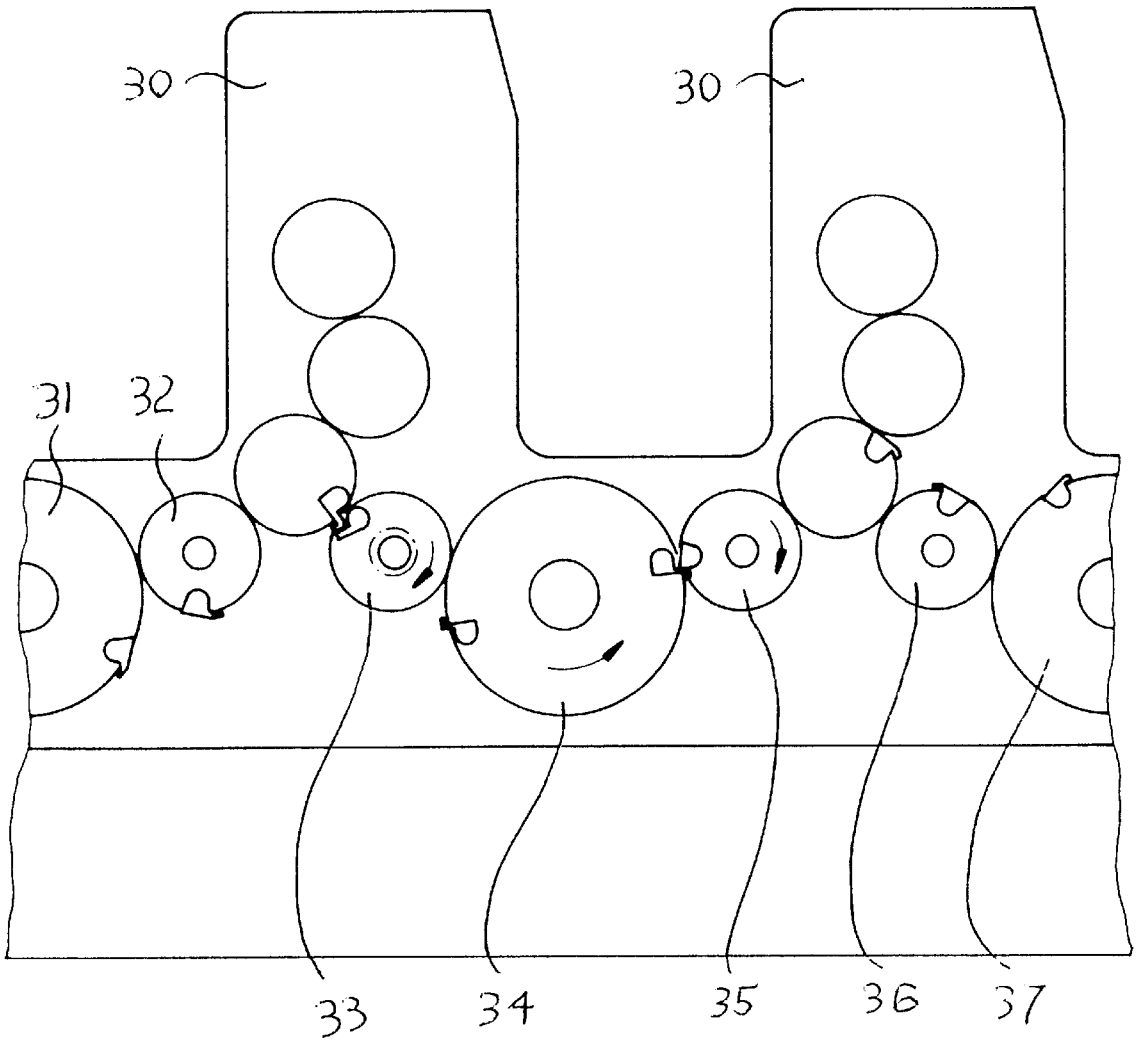
FIG. 4 is a schematic illustration of a printing press with a turning device which contains a double gear wheel as claimed by the invention.

FIG. 4 shows a multiple unit printing press in which the double gear of the present invention can be used. FIG. 4 shows two printing units 30. One of the cylinders 31, 32, 33, 34, 35, 36, 37, could possibly be connected to the double gear wheels 2, 4 of the present invention. In addition, the double gear wheels 2, 4 could possibly be connected to a cylinder not shown in FIG. 4.

One feature of the invention resides broadly in the double gear wheel of a turning device on printing presses, on which an adjustment gear wheel can be connected in its rotational position non-positively to a stationary gear wheel by means of a conical seat formed on the adjustment gear wheel and clamping means which contain a clamping body, characterized by the fact that on the stationary gear wheel 2, a conical recess 9 is formed, in which the conical seat 7 of the adjustment gear wheel 4 is engaged.

Another feature of the invention resides broadly in the double gear wheel characterized by the fact that the conical seat 7 is formed on a ring-shaped projection 8 of the adjustment gear wheel 4.

Yet another feature of the invention resides broadly in the double gear wheel characterized by the fact that on the side of the adjustment gear wheel 4 opposite the conical seat 7 there is an additional ring-shaped projection 11 with an additional conical seat 10, which additional conical seat 10 is engaged in an additional conical recess 12 formed on the clamping body 5.

Still another feature of the invention resides broadly in the double gear wheel characterized by the fact that the clamping body 5 is secured by means of studs 13 to prevent rotation with respect to the stationary gear wheel 2.

A further feature of the invention resides broadly in the double gear wheel characterized by the fact that the conical seat 7, 10 is arranged so that the adjustment gear wheel 4 is clamped in the direction toward its center.

Another feature of the invention resides broadly in the double gear wheel of a turning device on printing presses on which an adjustment gear wheel can be connected in its rotational position non-positively to a stationary gear wheel by means of a conical seat formed on the adjustment gear wheel and clamping means which contain a clamping body, characterized by the fact that the conical seat is formed by a conical internal boring 14 formed in the adjustment gear wheel 4' and a conical projection 15 which is formed on the stationary gear wheel 2 and extends into the internal boring 14, and that the clamping body 5 is engaged on the side of the adjustment gear wheel 4' opposite the stationary gear wheel 2, to clamp the gear wheels 2, 4' in the axial direction.

Yet another feature of the invention resides broadly in the double gear wheel as claimed in one of the preceding claims, characterized by the fact that the conical seat 7, 10 is realized so that it is not self-locking or irreversible.

Still another feature of the invention resides broadly in the double gear wheel with a turning device containing a double gear wheel, on which an adjustment gear wheel can be connected in its rotational position non-positively to a stationary gear wheel by means of a conical seat formed on the adjustment gear wheel and clamping means which contain a clamping body, characterized by the fact that on the stationary gear wheel 2, a conical recess 9 is formed, in which the conical seat 7 of the adjustment gear wheel 4 is engaged.

A further feature of the invention resides broadly in the double gear wheel with a turning device containing a double gear wheel, on which an adjustment gear wheel can be connected in its rotational position non-positively to a stationary gear wheel by means of a conical seat formed on the adjustment gear wheel and clamping means which contain a clamping body, characterized by the fact that the conical seat is formed by a conical internal boring 14 which is formed in the adjustment gear wheel 4' and a conical projection 15 which is formed on the stationary gear wheel 2 and extends into the internal boring 14, and that the clamping body 5 is engaged on the side of the adjustment gear wheel 4' opposite the stationary gear wheel 2 to clamp the gear wheels 2, 4' in the axial direction.

The following U.S. Patents may include driving devices for a printing press which could possibly be used with the present invention: No. 4,408,526; No. 5,123,507; No. 5,136,943; No. 4,864,927; No. 5,025,723; No. 5,031,531; and No. 5,042,380.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein, are hereby incorporated by reference as if set forth in their entirety herein.

The corresponding foreign patent publication applications, namely, Federal Republic of Germany Patent Application No. 295 18 072.2, filed on Nov. 15, 1995, having inventor Willi Becker, and DE-OS 295 18 072.2 and DE-PS 295 18 072.2 are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is riot to be taken as limited to all of the provided details thereof, since modifications and variations thereof may be made without departing from the spirit and scope of the invention.

What is claimed is:

1. A double gear wheel of a turning device for a printing press, said double gear wheel comprising:

an adjustable gear wheel;

a fixed gear wheel;

said fixed gear wheel comprising an arrangement for being fixedly connected to a shaft of a printing press;

a device to tighten said adjustable gear wheel and said fixed gear wheel non-rotationally together;

an arrangement to frictionally connect said adjustable gear wheel to said fixed gear wheel to permit adjustment of said adjustable gear wheel in a rotational direction with respect to said fixed gear wheel and provide a non-rotational surface frictional connection between said adjustable gear wheel and said fixed gear wheel upon tightening of said tightening device;

said frictional connecting arrangement comprising an inner conical portion disposed on one of said fixed gear wheel and said adjustable gear wheel;

said frictional connecting arrangement comprising an outer conical portion disposed on the other of said fixed gear wheel and said adjustable gear wheel; and said inner conical portion being disposed within said outer conical portion to mate with and frictionally engage with said outer conical portion to provide substantially the sole non-rotational frictional connection between said adjustable gear wheel and said fixed gear wheel.

2. The double gear wheel according to claim 1, wherein:

said inner conical portion is disposed on said adjustable gear wheel;

said inner conical portion comprises a conical seat;

said outer conical portion is disposed on said fixed gear wheel;

said outer conical portion comprising a conical recess;

said frictional connecting arrangement comprises said tightening device; and said tightening device comprises a clamping body.

3. The double gear wheel according to claim 2, wherein:

said conical seat is disposed on a ring shaped projection projecting from said adjustable gear.

4. The double gear wheel according to claim 3, wherein:

said clamping body comprises an arrangement to prevent rotation with respect to said fixed gear wheel; and said arrangement to prevent rotation comprises studs connecting said clamping body to said fixed gear wheel.

5. The double gear wheel according to claim 4, wherein:

said adjustable gear wheel has an axis of rotation;

said conical seat is disposed to receive a surface contact force upon said conical seat being engaged in said conical recess; and said conical seat is disposed to direct the surface contact force in a direction substantially toward said axis of rotation.

6. The double gear wheel according to claim 5, wherein:

said conical seat is configured to be non-locking to permit disengagement of said conical seat from said conical projection upon release of said tightening device.

7. The double gear wheel according to claim 2, wherein:

said adjustable gear wheel comprises a first side and a second side disposed opposite from one another;

said conical seat is disposed on said first side of said adjustable gear wheel;

said second side of said adjustable gear wheel comprises an additional ring-shaped projection;

said frictional connecting arrangement comprises an additional conical seat disposed on said additional ring-shaped projection projecting from said second side of said adjustable gear wheel;

said clamping body comprises an additional conical recess; and said additional conical seat being engaged in said additional conical recess.

8. The double gear wheel according to claim 7, wherein:

said clamping body comprises an arrangement to prevent rotation with respect to said fixed gear wheel; and said arrangement to prevent rotation comprises studs connecting said clamping body to said fixed gear wheel.

9. The double gear wheel according to claim 8, wherein:

said adjustable gear wheel has an axis of rotation;

said conical seats are disposed to receive a surface contact force upon said conical seats being engaged in said conical recesses; and said conical seats are disposed to direct the surface contact force in a direction substantially toward said axis of rotation.

10. The double gear wheel according to claim 9, wherein:

said conical seats are configured to be non-locking to permit disengagement of said conical seat from said conical projection upon release of said tightening device.

11. A double gear wheel of a turning device for a printing press, said double gear wheel comprising:

an adjustable gear wheel;

a fixed gear wheel;

said fixed gear wheel comprising an arrangement for being fixedly connected to a shalt of a printing press;

an arrangement for fractionally connecting said adjustable gear wheel to said fixed gear wheel to permit adjustment of said adjustable gear wheel in a rotational direction with respect to said fixed gear wheel;

said adjustable gear wheel comprises an internal bore;

said internal bore comprises an internal bore surface;

said frictional connecting arrangement comprising a conical seat disposed on said internal bore surface;

said frictional connecting arrangement comprising a conical projection projecting from said fixed gear wheel into said internal bore; and said conical seat being engaged by said conical projection.

12. The double gear wheel according to claim 11, wherein:

said frictional connecting arrangement comprises a clamping device; and said clamping device comprises a clamping body.

13. The double gear wheel according to claim 12, wherein:

said conical seat is configured to be non-locking to permit disengagement of said conical seat from said conical projection upon release of said clamping device.

14. A double gear wheel in a turning device for a printing press, said double gear wheel comprising:

an adjustable gear wheel;

a fixed gear wheel;

said fixed gear wheel being fixedly connected to a shaft of a printing press;

a device to tighten said adjustable gear wheel and said fixed gear wheel non-rotationally together;

an arrangement to frictionally connect said adjustable gear wheel to said fixed gear wheel to permit adjustment of said adjustable gear wheel in a rotational direction with respect to said fixed gear wheel and provide a non-rotational surface frictional connection between said adjustable gear wheel and said fixed gear wheel upon tightening of said tightening device;

said frictional connecting arrangement comprising an inner conical portion disposed on one of said fixed gear wheel and said adjustable gear wheel;

said frictional connecting arrangement comprising an outer conical portion disposed on the other of said fixed gear wheel and said adjustable gear wheel; and said inner conical portion being disposed within said outer conical portion to mate with and frictionally engage with said outer conical portion to provide substantially the sole non-rotational frictional connection between said adjustable gear wheel and said fixed gear wheel.

15. The double gear wheel according to claim 14, wherein:

said frictional connecting arrangement comprises said tightening device; and said tightening device comprises a clamping body.

16. The double gear wheel according to claim 15, wherein:

said inner conical portion is disposed on said adjustable gear wheel;

said inner conical portion comprises a conical seat;

said outer conical portion is disposed on said fixed gear wheel;

said outer conical portion comprising a conical recess; and said conical seat is disposed on a ring shaped projection projecting from said adjustable gear wheel.

17. The double gear wheel according to claim 16, wherein:

said clamping body comprises an arrangement to prevent rotation with respect to said fixed gear wheel;

said arrangement to prevent rotation comprises studs connecting said clamping body to said fixed gear wheel;

said adjustable gear wheel has an axis of rotation;

said conical seat is disposed to receive a surface contact force upon said conical seats being engaged in said conical recesses;

said conical seat is disposed to direct the surface contact force in a direction substantially toward said axis of rotation; and said conical seat is configured to be non-locking to permit disengagement of said conical seat from said conical projection upon release of said tightening device.

18. A double gear wheel in a turning device for a printing press, said double gear wheel comprising:

an adjustable gear wheel;

a fixed gear wheel;

said fixed gear wheel being fixedly connected to a shaft of a printing press;

an arrangement for frictionally connecting said adjustable gear wheel to said fixed gear wheel to permit adjustment of said adjustable gear wheel in a rotational direction with respect to said fixed gear wheel;

said adjustable gear wheel comprises an internal bore;

said internal bore comprises an internal bore surface;

said frictional connecting arrangement comprising a conical seat disposed on said internal bore surface;

said frictional connecting arrangement comprising a conical projection projecting from said fixed gear wheel into said internal bore; and said conical seat being engaged by said conical projection.

19. The double gear wheel according to claim 18, wherein:

said frictional connecting arrangement comprises a clamping device; and said clamping device comprises a clamping body.

20. The double gear wheel according to claim 19, wherein:

said conical seat is configured to be non-locking to permit disengagement of said conical seat from said conical projection upon release of said clamping device.

* * * * *

UNITED STATES PATENT AND TRADEMARK OFFICE

CERTIFICATE OF CORRECTION

PATENT NO. : 5,802,920

DATED : September 8, 1998

INVENTOR(S) : Willi BECKER

It is certified that error appears in the above-identified patent and that said Letters Patent is hereby corrected as shown below:

In column 8, line 29, after 'is', delete "riot" and insert --not--.

Signed and Sealed this

Twenty-second Day of June, 1999

*Attest:*

Q. TODD DICKINSON

*Attesting Officer*

*Acting Commissioner of Patents and Trademarks*